US008596357B2

(12) United States Patent
Nenniger

(10) Patent No.: US 8,596,357 B2
(45) Date of Patent: Dec. 3, 2013

(54) METHODS AND APPARATUSES FOR SAGD HYDROCARBON PRODUCTION

(76) Inventor: John Nenniger, Calgary (CA)

( * ) Notice: Subject to any disclaimer, the term of this patent is extended or adjusted under 35 U.S.C. 154(b) by 180 days.

(21) Appl. No.: 12/308,082

(22) PCT Filed: Jun. 5, 2007

(86) PCT No.: PCT/CA2007/000992

§ 371 (c)(1),
(2), (4) Date: Sep. 24, 2009

(87) PCT Pub. No.: WO2007/140598

PCT Pub. Date: Dec. 13, 2007

(65) Prior Publication Data

US 2010/0163229 A1 Jul. 1, 2010

(30) Foreign Application Priority Data

Jun. 7, 2006 (CA) ..... 2549614

(51) Int. Cl.
*E21B 43/24* (2006.01)

(52) U.S. Cl.
USPC ..... 166/272.1; 166/272.3

(58) Field of Classification Search
USPC ..... 166/272.3, 272.1
See application file for complete search history.

(56) References Cited

U.S. PATENT DOCUMENTS 2,412,765 A 12/1946 Buddrus et al.
2,896,725 A 7/1959 Reed
3,351,132 A 11/1967 Dougan et al.
3,512,585 A 5/1970 Allen
3,607,134 A 9/1971 McIntyre
3,608,638 A 9/1971 Terwilliger (Continued)

FOREIGN PATENT DOCUMENTS

CA 1059432 7/1979
CA 1065758 11/1979

(Continued)

OTHER PUBLICATIONS

Butler, R. & Mokrys, I., "A new process (VAPEX) for recovering heavy oils using hot water and hydrocarbon vapour", The Journal of Canadian Petroleum Technology, Jan.-Feb. 1991, The CIM/SPE Annual Technical Conference, p. 97-106, vol. 30, No. 1.

(Continued)

*Primary Examiner* — Angela M DiTrani
*Assistant Examiner* — Silvana Runyan
(74) *Attorney, Agent, or Firm* — Vidas, Arrett & Steinkraus, P.A.

(57) ABSTRACT

A process for recovering hydrocarbons from an in situ formation. The process includes the steps of injecting steam though an injection well into an underground extraction chamber having a hydrocarbon extraction interface, warming the hydrocarbons at the extraction interface to cause the hydrocarbons to flow downwardly by gravity drainage and to release dissolved hydrocarbon gases and moving the hydrocarbon gases from the extraction interface to improve heat transfer from said steam to said interface. The last step is to recover liquids such as hydrocarbons and water through a production well. The invention provides adding a buoyancy modifying agent to the steam to cause the hydrocarbon gases to accumulate in the well in a preferred location. The preferred location is at the top of the chamber where the gases protect the top of the chamber from being extracted to the point of breakthrough.

19 Claims, 5 Drawing Sheets

(56) References Cited

U.S. PATENT DOCUMENTS

| | | | | |
|---|---|---|---|---|
| 3,856,086 | A | 12/1974 | Braden, Jr. | |
| 3,913,672 | A | 10/1975 | Allen et al. | |
| 3,954,141 | A | 5/1976 | Allen et al. | |
| 3,990,513 | A | 11/1976 | Perch | |
| 4,004,636 | A | 1/1977 | Brown et al. | |
| 4,007,785 | A | 2/1977 | Allen et al. | |
| 4,007,786 | A | 2/1977 | Schlinger | |
| 4,008,764 | A | 2/1977 | Allen | |
| 4,022,277 | A | 5/1977 | Routson | |
| 4,127,170 | A | 11/1978 | Redford | |
| 4,160,479 | A | 7/1979 | Richardson et al. | |
| 4,280,559 | A | 7/1981 | Best | |
| 4,335,620 | A | 6/1982 | Adams | |
| 4,344,485 | A * | 8/1982 | Butler | 166/271 |
| 4,344,486 | A | 8/1982 | Parrish | |
| 4,362,213 | A | 12/1982 | Tabor | |
| 4,372,383 | A | 2/1983 | Ames | |
| 4,407,367 | A | 10/1983 | Kydd | |
| 4,418,752 | A | 12/1983 | Boyer et al. | |
| 4,450,913 | A | 5/1984 | Allen et al. | |
| 4,513,819 | A | 4/1985 | Islip et al. | |
| 4,531,586 | A | 7/1985 | McMillen | |
| 4,550,779 | A | 11/1985 | Zakiewicz | |
| 4,560,003 | A | 12/1985 | McMillen et al. | |
| 4,673,484 | A | 6/1987 | Babcock et al. | |
| 4,697,642 | A | 10/1987 | Vogel | |
| 4,753,293 | A | 6/1988 | Bohn | |
| 4,836,935 | A | 6/1989 | Lilienthal | |
| 4,884,635 | A | 12/1989 | McKay et al. | |
| 5,018,576 | A | 5/1991 | Udelle et al. | |
| 5,109,928 | A | 5/1992 | McCants | |
| 5,131,471 | A | 7/1992 | Duerksen et al. | |
| 5,145,003 | A * | 9/1992 | Duerksen | 166/272.3 |
| 5,224,536 | A | 7/1993 | Eigen et al. | |
| 5,407,009 | A * | 4/1995 | Butler et al. | 166/266 |
| 5,446,263 | A | 8/1995 | Eigen et al. | |
| 5,607,016 | A | 3/1997 | Butler | |
| 5,720,350 | A | 2/1998 | McGuire | |
| 5,771,973 | A | 6/1998 | Jensen et al. | |
| 5,795,784 | A | 8/1998 | Arnquist et al. | |
| 5,899,274 | A * | 5/1999 | Frauenfeld et al. | 166/401 |
| 6,230,814 | B1 | 5/2001 | Nasr et al. | |
| 6,296,809 | B1 | 10/2001 | Richards et al. | |
| 6,318,464 | B1 * | 11/2001 | Mokrys | 166/252.1 |
| 6,357,526 | B1 * | 3/2002 | Abdel-Halim et al. | 166/272.3 |
| 6,405,799 | B1 | 6/2002 | Vallejos et al. | |
| 6,511,601 | B2 | 1/2003 | McMurtrey et al. | |
| 6,644,400 | B2 | 11/2003 | Irwin, Jr. | |
| 6,662,872 | B2 * | 12/2003 | Gutek et al. | 166/272.4 |
| 6,883,607 | B2 | 4/2005 | Nenniger et al. | |
| 7,363,973 | B2 | 4/2008 | Nenniger et al. | |
| 7,514,041 | B2 | 4/2009 | Conquorgood et al. | |
| 7,727,766 | B2 | 6/2010 | Nenniger et al. | |
| 2003/0015321 | A1 | 1/2003 | Lim et al. | |
| 2003/0015458 | A1 * | 1/2003 | Nenniger et al. | 208/428 |
| 2003/0041663 | A1 | 3/2003 | Kossuth et al. | |
| 2010/0163229 | A1 | 7/2010 | Nenniger | |

FOREIGN PATENT DOCUMENTS

| | | |
|---|---|---|
| CA | 1070611 | 1/1980 |
| CA | 1102234 | 6/1981 |
| CA | 1122115 | 4/1982 |
| CA | 1141654 | 2/1983 |
| CA | 1208122 | 7/1986 |
| CA | 2108349 | 11/1993 |
| CA | 2147079 | 10/1996 |
| CA | 2185837 | 3/1998 |
| CA | 2243105 | 8/1999 |
| CA | 2235085 | 10/1999 |
| CA | 2567399 | 10/1999 |
| CA | 2241478 | 12/1999 |
| CA | 2251157 | 4/2000 |
| CA | 2270703 | 10/2000 |
| CA | 2281276 | 2/2001 |
| CA | 2304938 | 2/2001 |
| CA | 2323029 | 4/2001 |
| CA | 2299790 | 8/2001 |
| CA | 2633061 | 8/2001 |
| CA | 2351148 | 12/2002 |
| CA | 2374115 | 9/2003 |
| CA | 2436158 | 1/2005 |
| CA | 2549614 | 12/2007 |
| CA | 2552482 | 1/2008 |
| CA | 2591354 | 12/2008 |

OTHER PUBLICATIONS

Butler, R. & Mokrys, I., "Closed-Loop Extraction Method for the Recovery of Heavy Oils and Bitumens Underlain by Aquifers: The VAPEX Process", Petroleum Society of CIM and CANMET, Oct. 1993, Paper No. CIM.

Bulter, R. & Mokrys, I., "Recovery of Heavy Oils Using Vapourized Hydrocarbon Solvents: Further Development of the Vapex Process", The Journal of Canadian Petroleum Technology, Jun. 1993, pp. 56-62, vol. 32, No. 6.

Das, S. & Butler, R., "Effect of Asphaltene Deposition on the Vapex Process: A Preliminary Investigation Using a Hele-Shaw Cell", The Journal of Canadian Petroleum Technology, Jun. 1994, pp. 39-45, vol. 33, No. 6.

Das, S. & Butler, R., "Extraction of Heavy Oil and Bitumen Using Vaporized Hydrocarbon Solvents", Petroleum Science and Technology, 1997, pp. 51-75, vol. 15 (1&2).

Das, S., "Optimum Solvent Injection Strategy for Vapex Operation", The Petroleum Society, Jun. 1997, Paper No. 97-63.

Mokrys, I. & Butler, R., "In-Situ Upgrading of Heavy Oils and Bitumen by Propane Deasphalting: The Vapex Process", The Society of Petroleum Engineers, Inc., Mar. 1993, pp. 409-424, Paper No. 25452.

Palmgren, C. & Edmunds, N., "High Temperature Naptha to Replace Steam in the SAGD Process", Society of Petroleum Engineers, Inc., Jun. 1995, pp. 475-485, Paper No. 30294.

Singhal, A. et al., "Screening of Reservoirs for Exploitation by Application of Steam Assisted Gravity Drainage/ Vapex Processes", Society of Petroleum Engineers, Inc., Nov. 1996, Paper No. 37144.

* cited by examiner

Lab Data
Field Data
A
B
C
10,000
1,000
100
10
Mass Flux gm/m2hr
1
10
100
1000
10000
Viscosity cP 10,000,000
1,000,000
100,000
10,000
1,000
100
10
1
Viscosity cP
0
25
50
75
100
125
150
175
200
225
250
275
300
Temperature C Energy Savings (% compared to operation at 265C)
100%
90%
80%
70%
60%
50%
40%
30%
20%
10%
0%
0
50
100
150
200
250
300
Chamber Temperature C 13
10
1
9
12
2
4
3
8
14
6
6
7
15
5
11

Density kg/m3
Temperature C
5MPa
2.5MPa
1MPa
500kPa
Steam saturation curve
0
5
10
15
20
25
30
35
40
0
25
50
75
100
125
150
175
200
225
250
275
300

Vapour Density kg/m3
Temperature C
5 MPa with Hydrogen
2.5MPa with Hydrogen
1 MPa with Hydrogen
500 kPa with Hydrogen
Steam saturation curve
0
5
10
15
20
25
30
35
40
0
25
50
75
100
125
150
175
200
225
250
275
300

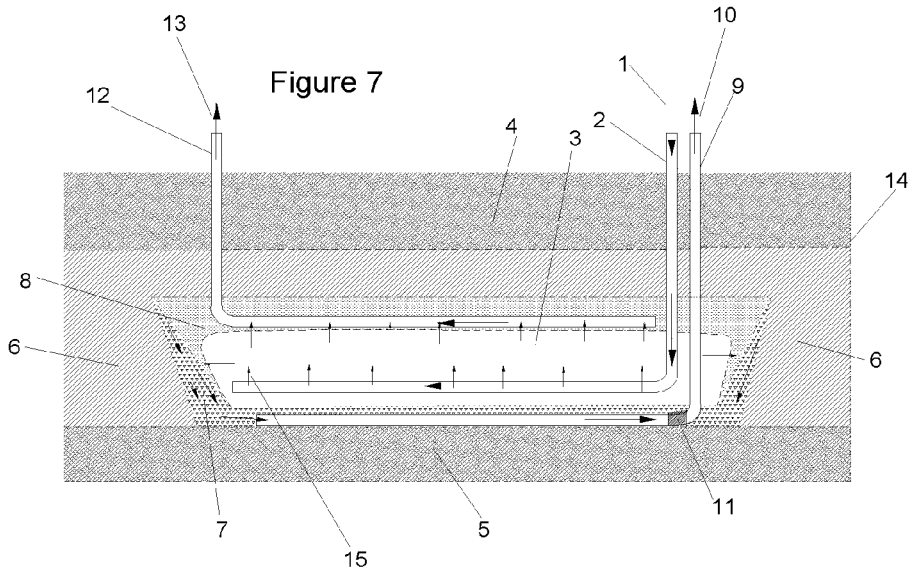
Figure 8
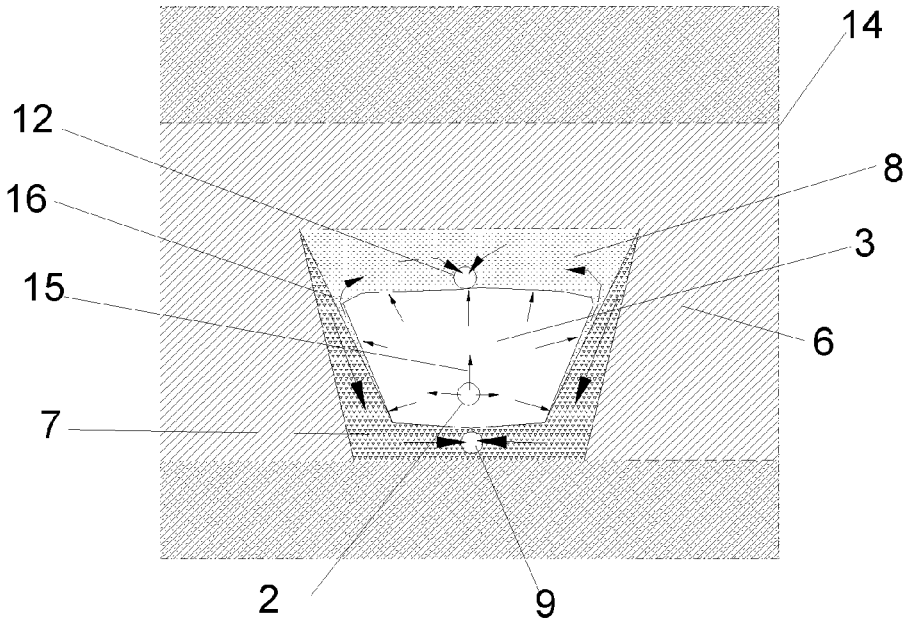

METHODS AND APPARATUSES FOR SAGD HYDROCARBON PRODUCTION

FIELD OF THE INVENTION

This invention relates generally to the recovery of hydrocarbons such as heavy oil or bitumen from tar sand or oil sand formations. In particular, this invention relates to the in situ recovery of such hydrocarbons through the use of steam assisted gravity drainage.

BACKGROUND OF THE INVENTION

Steam assisted gravity drainage (SAGD), is a well-known technique for recovery of oil from the tar sands. As the name implies, the technique uses steam, often injected at very high pressures and temperatures, to recover hydrocarbons in situ. In a typical SAGD extraction, the steam is injected into the formation from a generally horizontal injection well and recovered from a lower parallel-running generally horizontal production well. An extraction chamber is developed, first with communication between the wells and eventually up and around the well pair. As the steam flows towards the perimeter of the chamber, it encounters lower temperatures. These temperatures result in a condensation of the steam and then a subsequent flow of hot water that drains downwardly. In this way heat is transferred to the bitumen, causing the bitumen to warm up to the point of melting or flowing. The mobilized bitumen also drains downwardly and then the liquid water and bitumen are recovered from the formation through the production well located near the bottom of the chamber. As the mobilized bitumen drains down, fresh bitumen becomes exposed at an extraction interface that is subsequently heated by the ongoing steam condensation. The continuous drainage of bitumen from the sand results in the steam filled extraction (i.e. bitumen depleted) chamber growing over time. This chamber is called a gravity drainage chamber.

To ensure that the steam vapour does not short circuit directly from the injection well to the production well, the chamber is typically operated with what is called steam trap control. Steam trap control simply means that a liquid head of warmed bitumen and water is maintained above the production well, to ensure that the steam vapour cannot short circuit directly from the injection well into the production well, thereby bypassing the chamber to a large degree and failing to deliver heat to the bitumen at the extraction interface.

Steam trap control is implemented by restricting the fluid production from the production well to ensure that the production well is always immersed in liquid water and bitumen. Steam trap control thus tries to prevent any vapour production by only allowing liquids to be removed from the chamber. Steam trap control is often implemented by trying to achieve a target subcool value. The subcool refers to the temperature (i.e. degrees Centigrade) of the produced fluid below the thermodynamic condensation temperature at the chamber pressure. SAGD operators typically try to maintain fluid temperatures in the range of 5 C to more than 40 C below the condensation temperature of the steam in the chamber to minimize the amount of steam vapour short-circuiting from the production well.

SAGD is a field proven technology, but has low profit margins and huge environmental costs principally due to the tremendous amount of energy and water required to create the steam used in the process. Steam extraction produces large amounts of greenhouse gas emissions (approximately 250 pounds of $CO_2$ per barrel of bitumen) since fuel must be burned to produce the steam. Any way of reducing the energy requirement to extract the bitumen is both economically and environmentally desirable.

SUMMARY OF THE INVENTION

The present invention is directed to a steam recovery process that improves the energy efficiency of conventional SAGD extractions. The present invention can be used to reduce the energy requirement and cost or increase the production rates, by permitting the more efficient use of the heat of the steam in the formation. The present invention therefore is directed to an improved production method for SAGD with reduced environmental costs per unit of bitumen recovered.

According to the present invention the heating of the bitumen in situ causes the release of certain naturally occurring dissolved gases such as methane (but not restricted thereto) from the extraction surface into the chamber. Such gases are not very soluble in water, nor in heated bitumen and consequently these tend to accumulate within the extraction chamber. Due to the use of steam trap control, these gases will not be able to readily escape from the chamber. Due to the nature of the flow of steam within the chamber, from the injection well towards the extraction interface, these gases will be concentrated at or near the extraction surface and will accumulate there. Such accumulations can greatly interfere with the ability of the steam to reach the bitumen interface and efficiently transfer heat and reduces the steam condensation temperature.

The present invention is directed to methods and apparatuses for moving the barrier gases off the extraction surface and to manage the position of the gas blanket within the chamber, to permit more effective heat transfer from the steam and so to permit more effective bitumen recovery than can be achieved without management of these thermal barrier gases.

While the dissolved gas content and concentration within the bitumen varies with depth and with location, most of the tar and oil sand resources include a small, but in terms of a steam condensing process, a significant amount of dissolved gas naturally occurring within the bitumen. In this sense small becomes significant over time due to the accumulation of the gases at or near the extraction surface.

These naturally released barrier gases reduce efficient contact between the hot steam and the colder bitumen interface. Thus, the gas blanket reduces the temperature of the bitumen interface and consequently reduces the oil drainage rate (extraction rate) of the SAGD process. According to the present invention, managing the barrier gases to substantially reduce the thickness of the gas blanket on the extraction surface permits a more efficient use of the heat energy of the steam. One alternative is to achieve the same extraction rate with much lower steam temperatures and pressures resulting in reduced steam/oil ratios and energy costs. The present invention is therefore directed to an in situ SAGD recovery method that seeks to mitigate the harmful effect on heat transfer from the steam to the bitumen at the extraction surface caused by this naturally arising thermal barrier gases.

There are several embodiments which are comprehended by this invention, including but not limited to, inducing convective flow within the chamber, removing the gases from the chamber through a vent or bleed tube, and inducing a countercurrent flow of the gases upwardly as the bitumen and water are draining downwardly from the interface.

Therefore according to one aspect, the present invention provides a process for recovering hydrocarbons from an in situ formation wherein the process includes the steps of:

injecting steam though an injection well into an underground extraction chamber;

warming the bitumen enough to cause hydrocarbon gases dissolved in the bitumen to be released as vapors at an extraction surface; and moving said hydrocarbon gas vapours away from the extraction interface to improve heat transfer from said steam to said extraction interface.

According to a further aspect, the present invention provides a steam assisted gravity drainage process for removing bitumen from an underground formation, the process comprising the steps of:

adding a buoyancy modifying agent to said steam, transporting said buoyancy modifying agent through said chamber by said steam;

releasing said buoyancy modifying agent into naturally arising hydrocarbon gases as said steam condenses, said buoyancy modifying agent causing gases released by said bitumen to rise in said chamber, accumulating said gases at a top of said chamber and removing liquids from the chamber including water and bitumen.

In a further aspect of the present invention, the invention comprises a steam assisted gravity drainage process for removing bitumen from an underground formation through the formation of an extraction chamber having a sump, side wall extraction surfaces and a top extraction surface, the process comprising the steps of:

injecting steam as a vapour into the formation;

warming the in situ bitumen at a bitumen interface enough to cause the bitumen to drain by gravity drainage and to release barrier gases;

removing liquids from the chamber including water and bitumen;

and preferentially accumulating said barrier gases towards a top of said chamber to limit heat losses through the top of said chamber.

In a further aspect the method includes positioning a vent in the chamber to limit the thickness of the insulating layer of barrier gases.

BRIEF DESCRIPTION OF THE DRAWINGS

Reference will now be made to preferred embodiments of the present invention, by way of example only, in which:

FIG. 7 shows a schematic of a well arrangement which places a gas blanket barrier at the top of the formation to limit the vertical growth of the chamber;

FIG. 8 shows a cross-sectional view of the chamber of FIG. 7;

DETAILED DESCRIPTION OF THE PREFERRED EMBODIMENTS

In this specification the following terms shall have the following meanings. The term "barrier gases" shall mean gases other than steam that are found in an operating SAGD chamber. The gases will be primarily composed of methane and the primary source of the gases is the warming bitumen. However, there also may be additional gases, such as carbon dioxide and hydrogen sulphide evolving from the bitumen or from steam mineral reactions as well as gases other than steam that are introduced into the chamber as contaminants along with the steam. The gases that are most problematic and become barrier gases according to the present invention are those that have such a low solubility in hot water and bitumen that they tend to preferentially accumulate to fairly high concentrations at the perimeter of the chamber. What is of importance is not the source of the gases, but the management of such gases other than steam that accumulate in the chamber. The term bitumen shall mean heavy or viscous hydrocarbons and covers a wide range of in situ characteristics, such as might be found in the Alberta tar sands and would be considered suitable for SAGD extraction. In this specification the term "insulating" means that the temperature at the extraction interface is lower than it would be if insulating effect was not present. The effect of the insulation is not to block heat transfer but to cause a temperature drop across the "insulating blanket" as explained in more detail below.

Figure 1:
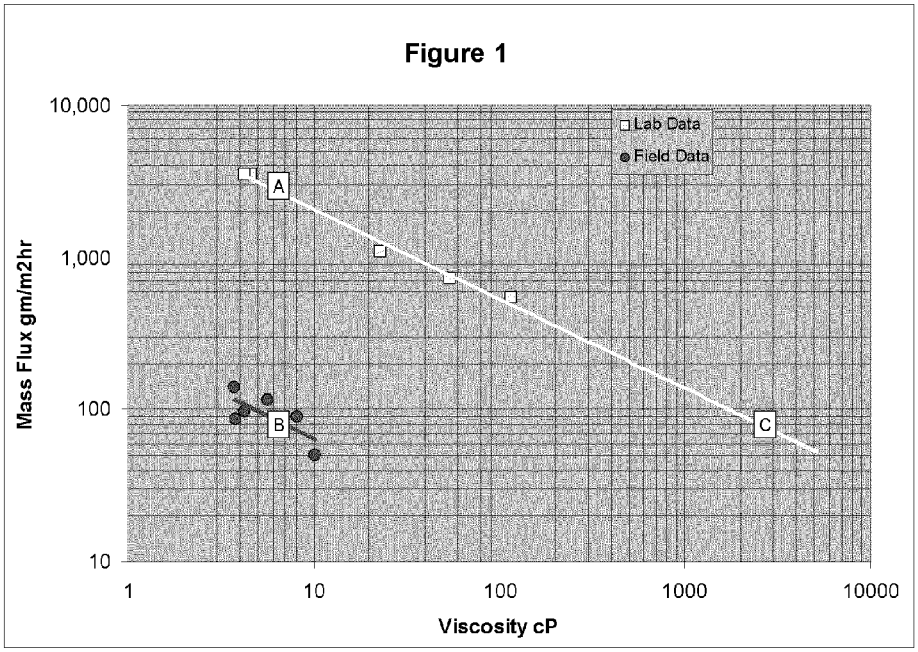
FIG. 1 shows a comparison between SAGD productivity as measured in laboratory experiments and SAGD productivity measured in commercial field applications.

FIG. 1 compares measured SAGD production rates for commercial field projects to lab scale tests. FIG. 1 shows the mass flux as a function of viscosity. The data for FIG. 1 was obtained from a number of public sources that provided extraction rates and viscosity for such bitumen samples. The data of FIG. 1 has also been adjusted to a common basis of 5 Darcy permeability, which is fairly representative for a typical commercial project. The mass flux is defined as bitumen production rate (gm/hr) divided by the vertical cross sectional area (m2) of the sandpack.

The following discussion shows how the mass flux is calculated. Yuan et al, JCPT, January 2006, FIG. 9, report production of 1150 gm/hr (=4000 gm in 210 minutes) for a SAGD laboratory experiment using Cold Lake bitumen in a 220 Darcy sand. The apparatus was 24 cm tall and 10 cm wide. The injection and production wells were located in the center of the sandpack so there were two vertical draining interfaces and a total vertical cross sectional area of 480 cm2 (=2×24×10). Thus, the experimental mass flux rate was 23,800 gm/m2 hr (=1150/0.0480 m2). To correct the mass flux to a permeability of 5 Darcy we have to multiply the laboratory measured mass flux by 0.15 (=square root of 5/220), so the equivalent mass flux is 3600 gm/m2 hr for a 5 Darcy sandpack. The SAGD experiment of Yuan was performed at 217 C, so the Cold Lake bitumen viscosity at 217 C is about 4 cP. This provides a laboratory SAGD measurement of 3600 gm/m2 hr at 4 cP.

Similarly, a field data point is obtained from Encana's Christina lake SAGD. The peak productivity in Phase 1 was about 1200 bbl/day (=8,000 kg/hr) per well for wells 700 m long. The pay height is reported to be about 40 m, so the vertical cross section area to flow is 56,000 m2 (=2×700×40). Therefore, mass flux is 140 gm/m2 hr (=8000×1000/56000).

The Commercial SAGD at Christina Lake is operated at 4.2 MPa, so the steam temperature is about 250 C and the bitumen viscosity at 250 C is about 4 cP. This provides a commercial field scale measurement of 140 gm/m2 hr at 4 cP, i.e. a factor of 25 times smaller than the rate observed in the lab. The discrepancy between field and lab is actually larger than 25 fold when one considers that Christina Lake is reported to have a permeability of 8 Darcies, and the lab experiment only captures production from a limited depth (40 cm) due to the finite dimensions of the experimental sandpack.

The discrepancy between lab and field rates has been, in the past, ascribed to a number of different factors, including the geometry of the actual in situ extraction chambers, local geological anomalies such as clay lenses, and the like. There are only two ways to explain this difference: the experiments are failing to mimic the true production viscosity or failing to mimic the true production temperature. FIG. 1 suggests that the discrepancy between the lab data at A and the field data at B would be resolved if the actual viscosity of the draining bitumen (i.e. at the interface) in the commercial projects is in the range of 1000 to 3000 cP at C rather than the 4-6 cP calculated using the steam condensation temperature.

Since the lab experiments try to match commercial conditions as closely as possible through the use similar oils, at similar conditions of porosity and pressure, it is believed that the viscosity difference is not due to an alteration of the fluid composition. Rather, it is believed the discrepancy in extraction rates arises because the actual operating temperatures at the extraction chamber surface achieved in the commercial SAGD operations are substantially lower than those temperatures obtained in the lab, which in turn does affect the viscosity of the bitumen. Such reduced extraction surface temperatures would explain the difference in extraction rates, as set out below.

Figure 2:
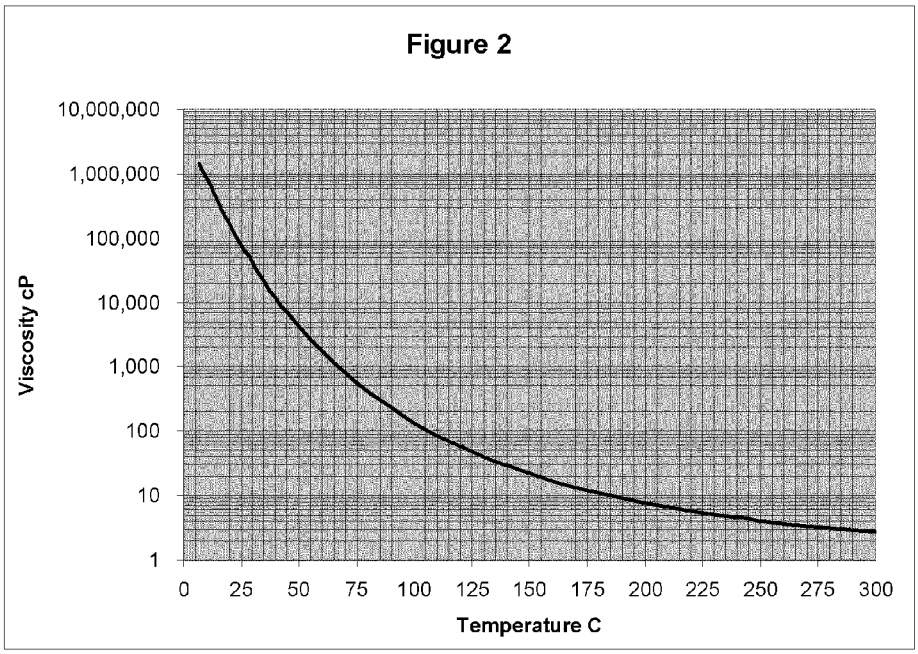
FIG. 2 shows viscosity as a function of temperature of typical Athabasca bitumen upon which SAGD is practiced.

FIG. 2 shows viscosity as a function of temperature for a representative sample of Athabasca bitumen. FIG. 2 shows that viscosities in the range of 1000 to 3000 cP are obtained for bitumen temperatures in the range of 55-65 C. Thus, FIG. 2, shows that bitumen interface temperatures of 55-65 C are consistent with the observed productivity (rate of interface movement) of commercial SAGD extractions. This is difficult to reconcile with the actual commercial SAGD's operating conditions, which include elevated steam pressures and temperatures typically in the range of 190 to 260 C. It appears that commercial SAGD projects achieve draining bitumen interface temperatures that are 130 to 200 C below the actual steam chamber temperatures.

According to the present invention, the temperature loss (i.e. difference between the steam condensation temperature and the bitumen interface temperature) is due to the accumulation of barrier gases (principally methane) in the extraction chamber, which have been naturally released from the bitumen as it is warmed by the steam. These hydrocarbon vapours are very effective at preventing efficient heat transfer between the condensing steam and the colder bitumen, by forming a type of gas barrier or insulating blanket between the source of the steam and the extraction interface 16.

Dissolved gases, primarily methane, and to a lesser extend other hydrocarbon gases are known to be present in the original in situ bitumen. Methane has very limited solubility in the produced liquids (hot bitumen and steam condensate). According to the present invention methane tends to accumulate as a vapour in the extraction chamber since with steam trap control the ability for methane to escape from the chamber is greatly restricted. As well, in the condensing steam process, there is a constant flow of steam exiting from the injection well and flowing outwardly towards the colder extraction surfaces where it condenses, in essence pushing the barrier gases onto the extraction surface generally over the whole extraction surface at the perimeter of the chamber. As well, it is believed that the barrier gas blanket will tend to be self healing—it will arise more quickly where ever the heat transfer rate is highest, ensuring that the barrier gas blanket is relatively uniform in depth.

Figure 3:
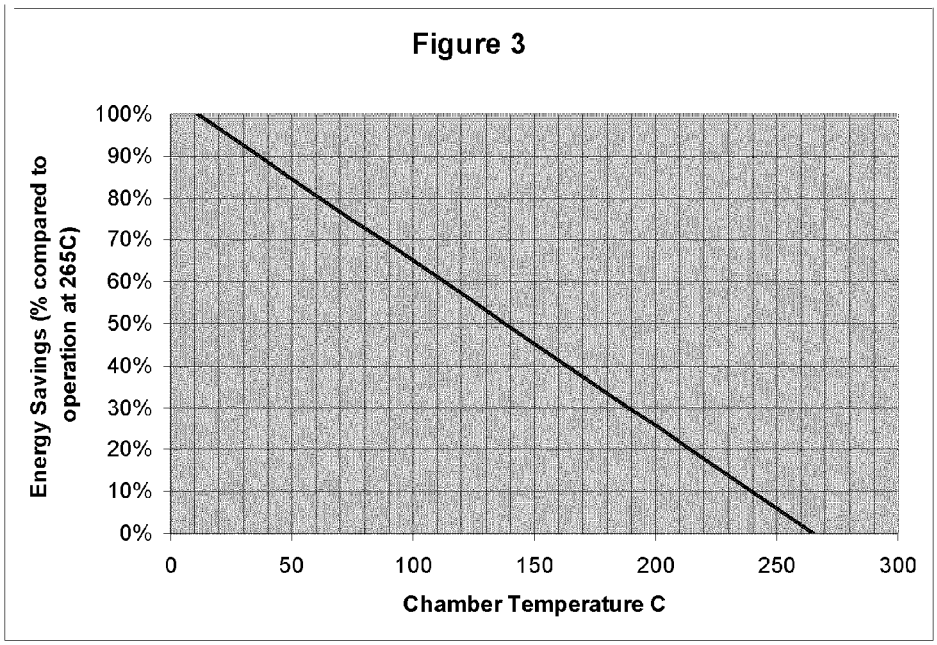
FIG. 3 shows the potential energy savings of the present invention as a function of chamber temperature.

FIG. 3 shows schematically that if the thermal insulating characteristics of the gas blanket could be eliminated (so the bitumen interface operates at a temperature close to the condensation temperature of the steam at chamber pressure i.e. at 50 to 65 C), then it would be theoretically possible to reduce overall SAGD energy requirement by about 80%, and produce or extract comparable amounts of bitumen from the formation. While this improvement in energy efficiency seems very high, according to the present invention the bitumen mobilization (ie warming enough to drain by gravity down the extraction interface) mostly occurs on the cold side of the gas blanket. The excess heat energy (i.e. the difference between 65 C and 265 C) is spent (wasted) heating sand that has already been drained and depleted of bitumen. FIG. 3 is also only an approximation because it assumes that the external overburden and underburden heat losses scale directly with the extraction temperature. These external heat losses also scale with the extraction rate and pay thickness, but for simplicity, these other sensitivities have not been included in FIG. 3.

Thus, according to the present invention, at current typical SAGD operating conditions, the complete elimination of the gas blanket could produce an energy savings of up to about 80% or approximately 1 mcf of natural gas per bbl of oil production. Given the cost of the energy needed to produce the steam, this translates to significant cost and environmental savings. Of course it will be understood by those skilled in the art that while the approximate maximum amount of energy savings is about 80%, it is expected in practice that the actual amount of savings will be less and may be considerably less, because there is a continuous source of fresh barrier gas entering into the chamber as bitumen is extracted.

Although the data of FIGS. 1 and 2 indicates that without the gas blanket it would be possible to achieve commercial extraction rates in a SAGD at temperatures as low as 50-65 C, this also requires the steam chamber to operate at sub-atmospheric pressures. This is generally not feasible—especially when one considers the associated problems of artificial lift and the wellbore hydraulics. It is believed that the practical lower temperature limits for steam are likely to be between 100 and 150 C, corresponding to a gauge pressures of 0 to about 4 atm. However, the present invention comprehends being able to achieve significant energy savings over SAGD without the methods of the present invention of at least 15%, preferable between 15% to 30% and most preferable in the range of 15% to 60% or more through the methods of the present invention.

The thermal conductivity of the formation is very sensitive to the nature of the fluid filling its pores. With dry sand, the conduction heat transfer is limited to the contact points from sand grain to grain, so the thermal conductivity decreases by a factor of perhaps 2-4 for dry (i.e. air filled) sand compared to bitumen and water saturated sand[1]. Thus, the barrier gas blanket doesn't have to be very thick for it to provide significant thermal resistance to the steam (temperature drop before the actual bitumen interface). The gas blanket is likely an efficient thermal barrier to the thermal energy of the steam in the chamber reaching the bitumen extraction surface at the chamber's outer edge.

[1] Michael Prats, Thermal Recovery SPE monograph 7, 1982, FIG. B.76, pg 229

Another aspect of the present invention is that the most prevalent released barrier gas, methane gas, has a density very similar to the steam. The molecular weights are 16 vs 18 gm/gm mol respectively. For a typical SAGD at 2.5 MPa chamber pressure, the density of pure methane is about 9.7 kg/m3 as compared to steam at 12.5 kg/m3. However, after accounting for the fact that the thermal barrier gas blanket is colder and the gas blanket is a mixture of methane and water vapour, the minimum density in the gas blanket is 11.6 at 180 C and the blanket density would climb to 14.4 kg/m3 as the temperature drops to 70 C. Such small differences in density and the fact that the blanket gas straddles the steam density mean that buoyancy effects are relatively inconsequential. Consequently, the methane gas blanket will be very persistent and the continual movement of steam from the injection well outwardly will cause the methane gas blanket to stay located at the extraction interface. The steam trap control will prevent the gas blanket gases from escaping the chamber. According to the present invention the gas blanket is likely to be almost neutral in buoyancy (density) and so will tend to accumulate where it is produced, namely, wherever there is steam condensation and bitumen warming at the extraction surface.

Having now described the evolution of these barrier gases within the extraction chamber, and their likely position and effect on the steam extraction process, it can now be understood how the methods of the present invention can be used to mitigate the thermal barrier effect these gases create between the heated steam and the extraction surfaces of the extraction chamber.

Figure 4:
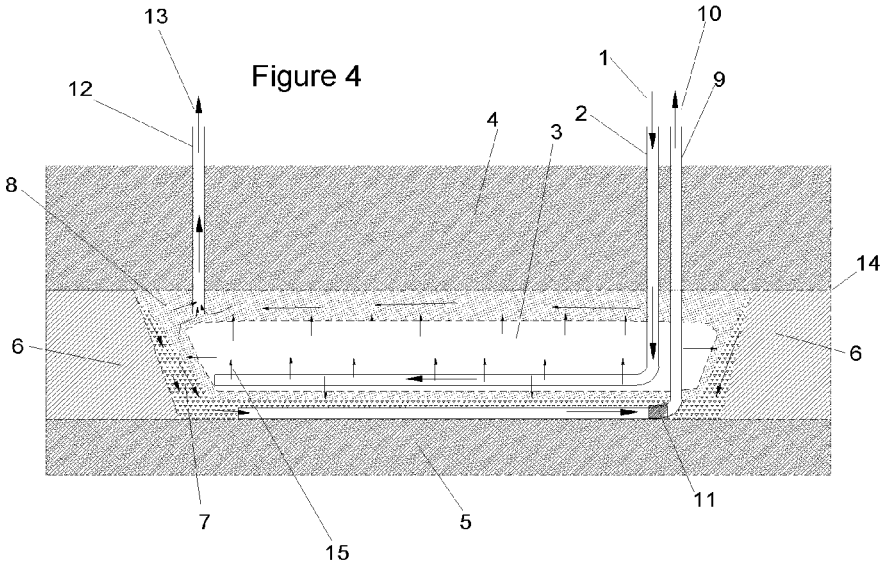
FIG. 4 shows a SAGD chamber according to one aspect of the present invention.

A steam assisted gravity drainage chamber according to one aspect of the present invention is shown in FIG. 4 at 3. The chamber 3 is formed within a hydrocarbon containing formation comprising an oil-bearing zone 6 with an overburden 4 and an underburden 5. The interface between the overburden 4 and the oil-bearing zone is indicated generally with the number 14. The chamber 3 contains a well 2 to inject steam 1 into the chamber 3. The steam 1 exits from the injection well 2 and travels 15 towards the perimeter of the chamber 3 where it encounters reduced (i.e. colder) temperatures and consequently condenses. The hot steam condensate mobilizes the in situ bitumen and the heated liquids 7 drain towards the bottom of chamber 3. A production well 9, collects drained fluids 10 and may use a pump 11 or other artificial lift means to lift the fluid above grade.

Naturally occurring gas dissolved in the bitumen is released as the bitumen is heated and collects in a barrier gas blanket shown schematically as 8. According to one aspect of the present invention a purge well 12 provides a means to remove the accumulated gases 13 from the blanket 8 to improve heat transfer between the steam chamber 3 and the liquefied bitumen 7.

As can now be appreciated, steam trap control is likely very effective at trapping and accumulating the barrier gases in the extraction chamber because the solubility of these naturally arising barrier gases in the produced liquids is very low. Unless there is a loss of confinement within the formation, the gas blanket will accumulate over time until the methane reaches such a high concentration within the chamber that the methane entering the chamber via the out-gasing from the bitumen is equal to the methane leaving the chamber in the produced fluids (and any other leak paths around the perimeter of the chamber). At this point, though given the low solubility, the methane concentrations within the chamber are likely to be very high, corresponding to thick and thermally insulating gas blankets on virtually every extraction surface. The density discussion above shows that the gas blanket has near neutral buoyancy, so it can and likely will persist, where formed, on the bitumen interface.

To mitigate the thermal resistance of the gas blanket, the present invention provides methods of physically moving or displacing the gas blanket away from the extraction interface 16, including by purging the gases from the chamber through a gas vent, or changing the characteristics of the gases to cause them to move off the interface as described in more detail below. The vent will experience steam condensation and liquid hold up in the vent can create a barrier to gas removal. This type of blockage will be removed. A number of means may be used including briefly reversing the flow in the vent tube, inserting a pump, using insulated tubing or using other techniques such a plungers or the like to overcome this liquid barrier.

One approach to mitigate the gas blanket is to induce a convective flow within the steam chamber. This could be achieved by injection of steam at the heel of the injection well and removal of a purge gas stream at the toe. Alternatively, steam can be injected at the toe and a purge gas stream can be removed at the heel. Alternatively steam can be injected at both the heel and the toe and a bleed or chamber purge could be located at or near the midpoint of the horizontal well. The challenge with this approach is that the gas blanket is self healing, so it is very difficult to induce a convective flow along the length of the chamber to sweep the blanket from the chamber walls defined by the extraction interface 16 towards a purge well. More likely the convective flow will simply lead to steam short-circuiting so while comprehended by the present invention this alternative is not the most preferred aspect. Further, even if the gas blanket is temporarily displaced away from a particular area of the extraction interface 16, then the localized steam condensation rate will increase and produce an opposing outflow of gases to recharge the blanket at that location.

A more preferred approach to mitigate the harmful effects of the gas blanket according to the present invention is to cause the gas blanket to flow away from the extraction interfaces 16 on the walls of the chamber in a more controlled manner. Thus, the present invention comprehends adding a vent path or tube 12 as shown in FIG. 4 to simply remove the barrier gas blanket from the chamber. However, this approach is also not the most preferred as it would be difficult to reliably remove the gas blanket through such a vent, considering that the chamber expands and the gas blanket will tend to expand and stay against the extraction interface 16 of the chamber.

Figure 5:
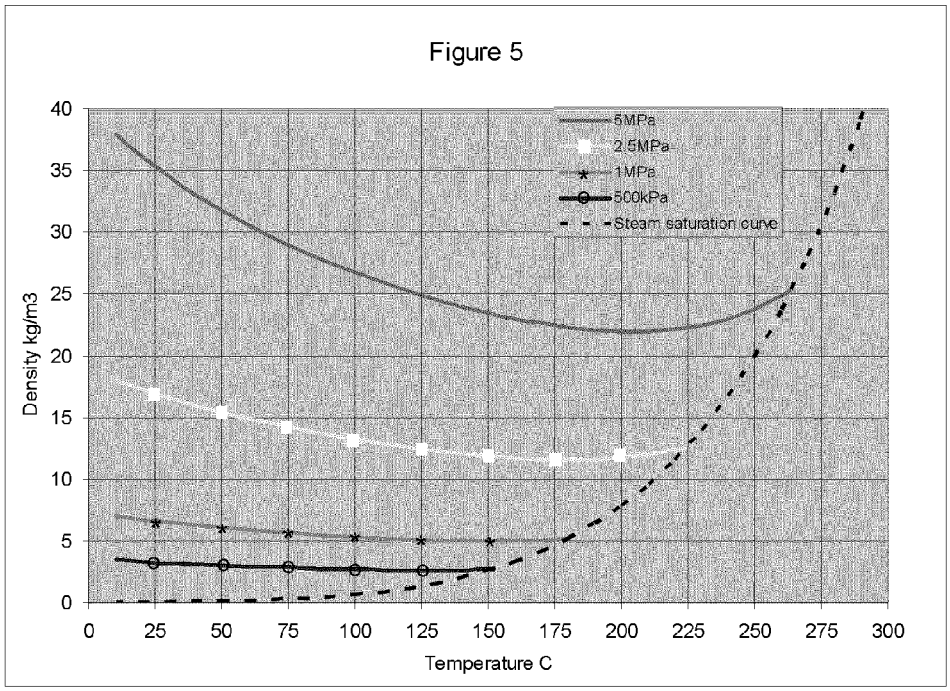
FIG. 5 shows the density of the of the blanket gas in a typical SAGD as a function of temperature at several pressures. The density of pure saturated steam vapour is also shown for reference.

FIG. 5 shows the density of gas in the gas blanket as a function of temperature for typical SAGD conditions at pressures ranging from 500 kPa to 5 MPa. The composition of the gas blanket is determined by the steam being at saturated pressure at the given temperature with the balance of the pressure arising from the methane gas. There is a slight amount of buoyancy at 5 MPa (i.e. the density drops from about 25 kg/m3 down to about 22 kg/m3) but in the more preferred (i.e. more energy efficient) pressure range 0.5 to 2.5 MPa, the gas blanket is almost neutral buoyancy with the steam.

A preferred aspect of the present invention therefore comprehends adding a buoyancy-modifying agent to the steam, for example, by injecting an effective amount of agent into the steam on the surface, which is then delivered by the steam into the chamber to enhance the buoyancy of the barrier gas blanket within the chamber. Just as the barrier gas blanket is held to the extraction surface by the continuous flow of steam outwardly to the extraction surface of the chamber, so too will the buoyancy-modifying agent be also delivered to the extraction surfaces of the chamber. Most preferably the steam will carry the buoyancy-modifying agent along, until the steam condenses, at which point the agent will be released from the steam. This release will take place at or in the gas blanket, and so the steam can be effectively used to transport the agent directly to where it is most desired. Examples of suitable buoyancy modifying agents are gases which will remain gases at chamber conditions and which have most preferably a lower molecular weight than the steam and methane, such as hydrogen and helium. Hydrogen has the advantage that it is readily available and inexpensive, and helium is preferred as it is relatively benign. These low molecular weight agents upon being delivered and placed into the barrier gas blanket will increase the buoyancy of the barrier gas blanket, tending to make it flow upwardly towards a top or roof or the extraction chamber. While the following discussion is primarily directed to agents that cause the gas blanket to rise, the present invention also comprehends the use of agents that tend to cause the gas blanket to sink to where it can then be vented from the bottom of the chamber, but the ones causing a rise are believed to be more preferred. It can be more difficult to recover the gases from the bottom of the chamber.

Figure 6:
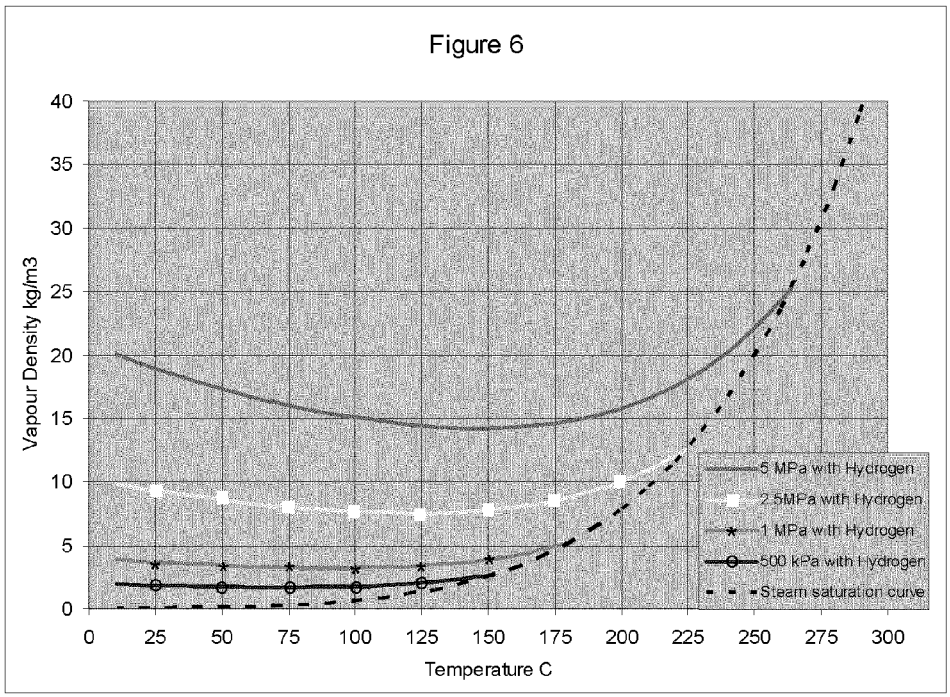
FIG. 6 shows the effect of mixing a buoyancy modifying agent into the steam on the density of the gas blanket according to a further aspect of the present invention.

The buoyancy of the gas blanket can be greatly increased by adding sufficient hydrogen to it. FIG. 6 shows by way of example, a 1:1 mix of hydrogen to methane in the gas blanket. More specifically, at 2.5 MPa, the maximum buoyancy is increased from about 0.9 kg/m3 (as discussed above) to about 5 kg/m3. For an insitu gas oil ratio of 5, this 1:1 mix corresponds to a dose rate of 50 kg of hydrogen per 350,000 kg of steam or about 140 ppmw. FIG. 6 also shows that with a 1:1 dose of hydrogen to methane, the gas blanket at 2.5 MPa is buoyant over its entire temperature range including the original reservoir temperature. FIG. 6 shows that the buoyancy benefits are also observed at lower pressures (i.e. in the more energy efficient range). The benefits are not as dramatic but still quite significant. For example, the buoyancy at 500 kPa can be increased by almost 1 kg/m3 and the downward barrier gas flow at the bitumen interface eliminated.

While these examples show a particular dosing rate of agent to add to achieve the change in buoyancy noted above, the present invention contemplates that various dosing amounts of agent can be added without departing from the scope of the invention. FIG. 6 shows that the buoyancy advantage achieved by the addition of the agent is less for chambers operating at reduced pressures. Consequently it is anticipated that the dose rate would be adjusted to achieve the optimum commercial benefit for the particular extraction conditions. If the amount added only doubled the buoyancy, the gas blanket would still tend to migrate upwardly, albeit more slowly. Thus the present invention comprehends a wide range of dose rates of buoyancy agent, provided that an effective amount of the agent is added to cause the gas blanket to preferentially flow or move away from the interface to permit improved heat transfer from the steam to the interface and to accumulate the barrier gases in a preferred location. In the preferred aspect, the gas blanket floats towards a top of the extraction chamber. The preferred buoyancy effect is at least 0.1 kg/m3 to 20 kg/m3 preferably 0.1 to 10 kg/m3 and most preferably 0.1 to 5 kg/m3. Thus, depending upon the extraction chamber conditions the dosing rates comprehended include: $H_2$:$CH_4$ dosing rate ratios of about 1:10, 1:5, 1:2, 1:1, 2:1, 4:1 or 10:1, or any ratios there between.

It will be appreciated by those skilled in the art that the present invention contemplates varying the dosing rate over time to suit changes in conditions and according to the local dissolved gas concentrations. One way to monitor the effectiveness of the dosing rate is to monitor the production rate. A slow down of production may signal an accumulation of gas blanket and so the dosing rate can be increased. Conversely, if an increase in dosing rate fails to increase the production rate, then the gas blanket is not being further thinned by the extra buoyancy agent and the rate can be reduced or stabilized. The hydrogen dose rate can also be chosen on the basis of the ratio of hydrogen to methane collected in the purge gas.

The dosing rate of the steam with a buoyancy modifying agent such as hydrogen can have the additional benefit that the gas blanket will be buoyant throughout the entire temperature range (i.e. all the way down to original in situ temperature), so the hydrogen eliminates the potential for downflow at the outside face of the blanket. Consequently hydrogen, at appropriate concentrations is expected to be very effective for moving the blanket away from the extraction surfaces. As more of the barrier gases are moved away, more of the cold interface is exposed, causing more steam to rush in to condense, causing more barrier gas to be released but also causing more hydrogen to be delivered and so on. Thus, this aspect of the present invention provides an answer to the healing property of the barrier gas blanket in that the doped steam will deliver more buoyancy-modifying agent to the places where the most methane vapour is being released from the bitumen.

It will now be appreciated that the addition of a buoyancy modifying gas will cause the barrier gas to rise up, moving away from the side-wall extraction surfaces, but it will then accumulate against the top or ceiling of the chamber. The result of the preferred doping agent therefore is to have a thinner barrier gas blanket on the side walls of the chamber where the bitumen extraction takes place, and a thicker barrier gas blanket at the top of the chamber. However, accumulating the barrier gases at the top of the chamber leads into another aspect of the present invention.

FIG. 7 shows a side view of a configuration of the invention with a horizontal purge well 12 located some distance below the top of the formation. FIG. 7 shows the bitumen bearing zone extending above the gas blanket. FIG. 8 shows the horizontal well configuration of FIG. 7 in cross section. The gas blanket flows upwards extraction interface 16, due to the use of the buoyancy additive as taught in this invention. By making the gas blanket buoyant, the barrier gas blanket will become much thinner at the sidewalls of the extraction chamber as it drains continuously upwards towards the top of the chamber. A thicker gas blanket at the top of the chamber is also desired to reduce heat losses through the top of the chamber to the overburden. Furthermore, the thicker barrier gas layer at the top of the chamber can be used to limit upward extraction. At a certain thickness of the barrier gas layer, there will little if any additional vertical extraction. Thus, the gas blanket can be used to prevent upward chamber growth and a loss of confinement and thereby prevent a steam chamber blow out as can happen in SAGD extractions.

According to the present invention there is also provided a means to position and control the thickness of the accumulated gas blanket, now positioned as a floating layer at the top of a chamber. For example, if the blanket becomes too thick at the top of the chamber it may restrict horizontal extraction into the pay, and may eventually fill the chamber and prevent further extraction. Thus the present invention further provides that by positioning at least one bleed well 12 at a predetermined distance below the top of the pay zone a highly insulating gas blanket can be positioned and maintained near the top of the chamber. The thickness of the blanket can be chosen so that it greatly reduces or stops the vertical extraction (and heat loss) of the chamber while still encouraging rapid horizontal growth and commercially attractive extraction rates. The position of the bleed or vent well can also be used to control the thickness of the floating gas blanket, by draining the gases from the chamber once they extend down from a top of the chamber far enough. In this sense the bleed well or vent will provide a means to remove gases and vapours from the extraction chamber. Depending upon the position of the bleed well as compared to the lower surface of the floating gas blanket, more or less steam vapour will also be removed from the extraction chamber. As can now be appreciated, by positioning the bleed well at a predetermined level below the top of the pay zone, an upper limit can be defined for the vertical extraction, meaning the present invention can be used to control the risk of blow outs. The risk of blowout is mitigated by two separate benefits of the present invention, limiting the vertical growth rate of the chamber above a certain position as well as being able to achieve commercially attractive bitumen extraction rates on the side walls, while operating the steam chamber at reduced pressures and more energy efficient temperatures.

Figure 9:
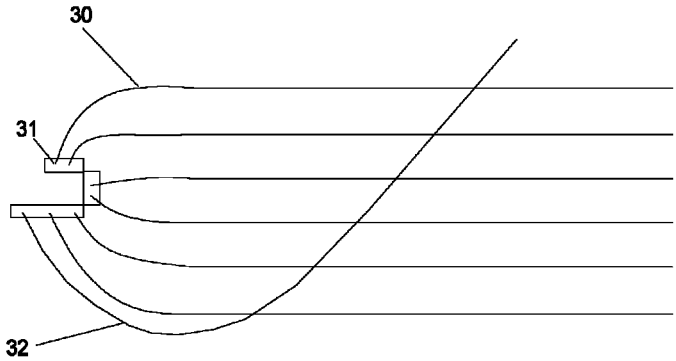
FIG. 9 shows a schematic layout for a pad consisting of 6 horizontal SAGD well pairs with an additional purge or vent well according to another aspect of the present invention.

FIG. 9 shows an alternative to a vertical vent or a parallel horizontal vent. FIG. 9 shows a well pad 31, containing a number of well pairs, with an additional nonparallel horizontal vent well 32 across the injection and production wells 30 in the pad. This purge, bleed or vent well 32 would be preferentially located close to a structural high in the formation to facilitate collection of the gas blanket from the top of the chamber. While only one such horizontal purge well is shown in FIG. 7, the present invention comprehends that more than one can be used.

It can now be appreciated that the top layer of insulating gas barrier of the present invention to limit the vertical rise of the extraction chamber will help address the gas over bitumen problem or water over bitumen problem common to many areas of the tar sands. More specifically moving the gas blanket off the extraction interface 16 can provide commercially attractive extraction rates at lower chamber pressures and temperatures and greatly reduce the risk of loss of steam chamber confinement. The use of a third horizontal well, as a gas vent below the top of the pay zone together with a buoyancy modifying agent effectively allows the operator to place a gas blanket barrier at the top of the pay zone of a predetermined thickness. This barrier will be effective at limiting the heat conduction upwards so the bitumen at the top of the chamber can remain relatively cold and immobilized, encouraging chamber integrity.

One of the aspects of the present invention is to remove the barrier gases from the chamber in a controlled fashion. Preferred purge rates range from by weight percent, 0.1%, to 0.5%, to 1%, to 3% to 5% and to 10% of the steam injection rates. Alternatively, the purge rate can be controlled by measuring the temperature and/or concentration of the vented or purged gas such that enough barrier gas is removed to control the blanket thickness and the actual amounts removed will vary according to extraction chamber conditions.

Figure 10:
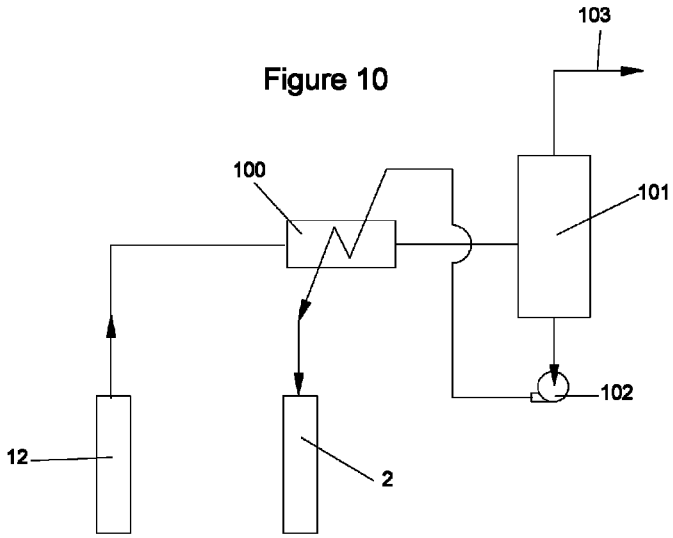
FIG. 10 shows a schematic for a surface separation facility to purify the purge vapour stream and recycle the steam back into the chamber.

A surface facility to separate gases such as methane 103 from the purge or vent gas from the extraction chamber is shown schematically in FIG. 10. This facility could use any convenient separation process 101 including distillation, flash, membrane separation and the like. Recovery and recycling the hydrogen is therefore an option according to the present invention. The surface facility might include heat exchangers 100, pumps 102 and the like to strip the gases 103 from the steam. The steam may be reinjected back into the reservoir via injection well 2 in some cases.

The methane or hydrogen can be used for fuel gas, for example to create additional steam. The present invention also comprehends a method to capture and recycle the buoyancy-modifying agent for recycle, if desired.

The purge of the gas blanket could be conducted on either a continuous or on a periodic/intermittent basis. The purge rate will be determined by any reasonable means, but preferred ways include either monitoring the composition of the purge gas or the temperature profile in the purge well.

In the foregoing description reference was made to preferred embodiments of the invention. It will be understood by those skilled in the art that various modifications and alterations can be made to the invention without departing from the broad scope of the claims which are attached. Some of these modifications have been described above and others will be apparent to those skilled in the art.

The invention claimed is:

1. A process for recovering hydrocarbons from an in situ formation wherein the process includes the step of:

injecting steam through an injection well into an underground extraction chamber having a hydrocarbon extraction interface;

warming the hydrocarbons at the extraction interface to cause the hydrocarbons to flow downwardly by gravity drainage and to release dissolved hydrocarbon gases, including hydrocarbon barrier gases;

moving at least the hydrocarbon barrier gases away from the extraction interface to improve heat transfer from said steam to said interface, said step of moving at least the hydrocarbon barrier gases away from the extraction interface comprising adding a buoyancy modifying agent to said hydrocarbon barrier gases to cause said hydrocarbon barrier gases to rise in said chamber towards a top of said chamber, accumulating said barrier gases at a top of said chamber; and recovering said hydrocarbons through a production well.

2. The process for recovering hydrocarbons from an in situ formation as claimed in claim 1 wherein said step of moving at least the hydrocarbon barrier gases away from the extraction interface further comprises displacing at least said hydrocarbon barrier gases away from said extraction interface by steam convection.

3. The process for recovering hydrocarbons from an in situ formation as claimed in claim 2 wherein said step of displacing at least said hydrocarbon barrier gases further includes venting at least said hydrocarbon barrier gases out a vent placed in said chamber.

4. The process for recovering hydrocarbons from an in situ formation as claimed in claim 1 further includes using a vent to remove at least the hydrocarbon barrier gases, wherein said vent is a separate flow path from said injection and production wells.

5. The process for recovering hydrocarbons from an in situ formation as claimed in claim 1, further including the step of positioning a vent in said formation to vent at least said hydrocarbon barrier gases.

6. The process for recovering hydrocarbons from an in situ formation as claimed in claim 5 wherein said vent is positioned adjacent to but below a top of a pay zone in said formation.

7. The process for recovering hydrocarbons from an in situ formation as claimed in claim 5 wherein said vent is sized, shaped and positioned to permit a thickness of a barrier gas layer at a top of said pay zone to be controlled.

8. A steam assisted gravity drainage process for removing bitumen from a chamber in an underground formation, the process comprising the steps of:

injecting steam as a vapour into the chamber;

adding a buoyancy modifying agent to the steam;

warming the in situ bitumen at a bitumen interface enough to cause the bitumen to drain by gravity drainage;

removing liquids from the chamber including water and bitumen; and removing from the chamber hydrocarbon gases which are released from said bitumen as said bitumen warms at said interface, wherein said hydrocarbon gases include hydrocarbon barrier gases.

9. The steam assisted gravity drainage process for removing bitumen from a chamber in an underground formation as claimed in claim 8 wherein said hydrocarbon barrier gases are removed from a region of said chamber adjacent to said bitumen interface.

10. The steam assisted gravity drainage process for removing bitumen from a chamber in an underground formation as claimed in claim 8 wherein the process includes the step of inducing convective flow within the chamber.

11. The steam assisted gravity drainage process for removing bitumen from a chamber in an underground formation as claimed in claim 9 wherein the step of inducing convective flow within the chamber comprises injecting steam at a heel of said chamber and removing said hydrocarbon barrier gases at a toe of said chamber.

12. The steam assisted gravity drainage process for removing bitumen from a chamber in an underground formation as claimed in claim 9 wherein the step of inducing convective flow within the chamber comprises injecting steam at a toe of said chamber and removing said hydrocarbon barrier gases from a heel of said chamber.

13. The steam assisted gravity drainage process for removing bitumen from a chamber in an underground formation as claimed in claim 9 wherein the step of inducing convective flow within the chamber comprises injecting steam at both a heel and a toe of said chamber and removing said hydrocarbon barrier gases from a location around a midpoint of the chamber.

14. The steam assisted gravity drainage process for removing bitumen from a chamber in an underground formation as claimed 8 in claim wherein said buoyancy modifying agent is a gas at extraction conditions.

15. The steam assisted gravity drainage process for removing bitumen from a chamber in an underground formation as claimed in claim 8 wherein said buoyancy modifying agent is lighter than steam.

16. The steam assisted gravity drainage process for removing bitumen from a chamber in an underground formation as claimed in claim 15 wherein buoyancy modifying agent is one or more of hydrogen and helium.

17. The steam assisted gravity drainage process for removing bitumen from a chamber in an underground formation as claimed in claim 14 wherein said buoyancy modifying agent is more dense than steam.

18. A steam assisted gravity drainage process for removing bitumen from a chamber in an underground formation, the process comprising the steps of:

adding a buoyancy modifying agent to said steam, transporting said buoyancy modifying agent through said chamber by said steam;

as said steam condenses, releasing said buoyancy modifying agent into a region of said chamber containing naturally arising hydrocarbon gases, including hydrocarbon barrier gases, said buoyancy modifying agent causing at least said hydrocarbon barrier gases released from said bitumen to rise in said chamber;

accumulating at least said hydrocarbon barrier gases at a top of said chamber; and removing liquids, including water and bitumen, from the chamber.

19. A steam assisted gravity drainage process for removing bitumen from an underground formation through the formation of an extraction chamber having a sump, side wall extraction surfaces and a top extraction surface, the process comprising the steps of:

injecting steam as a vapour into the formation;

adding a buoyancy modifying agent to said steam. transporting said buoyancy modifying agent through said chamber by said steam;

warming the in situ bitumen at a bitumen interface enough to cause the bitumen to drain by gravity drainage and to release barrier gases, said buoyancy modifying agent causing at least said barrier gases to rise in said chamber;

removing liquids, including water and bitumen, from the chamber; and accumulating said barrier gases towards a top of said chamber to insulate the top of the chamber from said steam.

* * * * *